US010988910B2

(12) United States Patent
Grawe

(10) Patent No.: US 10,988,910 B2
(45) Date of Patent: Apr. 27, 2021

(54) PRE-CAST CONCRETE WALL STRUCTURES, AND METHODS FOR MANUFACTURING AND INSTALLING THE SAME

(71) Applicant: James Grawe, North Tonawanda, NY (US)

(72) Inventor: James Grawe, North Tonawanda, NY (US)

( * ) Notice: Subject to any disclaimer, the term of this patent is extended or adjusted under 35 U.S.C. 154(b) by 0 days.

(21) Appl. No.: 16/562,089

(22) Filed: Sep. 5, 2019

(65) Prior Publication Data

US 2021/0071383 A1 Mar. 11, 2021

(51) Int. Cl.

| | |
|---|---|
| ***E02D 29/02*** | (2006.01) |
| ***B28B 13/02*** | (2006.01) |
| ***E04C 2/04*** | (2006.01) |
| ***B28B 1/29*** | (2006.01) |

(52) U.S. Cl.

CPC ..... *E02D 29/0266* (2013.01); *B28B 1/29* (2013.01); *B28B 13/022* (2013.01); *E04C 2/044* (2013.01)

(58) Field of Classification Search

CPC ..... E02D 29/0266; B28B 13/022; B28B 1/29; E04C 2/044

USPC ..... 52/223.7

See application file for complete search history.

(56) References Cited

U.S. PATENT DOCUMENTS

| | | | | | |
|---|---|---|---|---|---|
| 2,920,475 | A * | 1/1960 | Graham | E04B 1/215 | 52/432 |
| 3,775,928 | A * | 12/1973 | Dawson | E04B 1/043 | 52/745.13 |
| 3,884,005 | A * | 5/1975 | Wey | E04B 5/04 | 52/583.1 |
| 4,087,947 | A * | 5/1978 | Turner | E04G 15/04 | 294/90 |
| 4,575,984 | A * | 3/1986 | Versteeg | E01C 5/08 | 52/591.2 |
| 5,248,549 | A * | 9/1993 | Silva | E04C 2/044 | 428/192 |
| 5,570,552 | A * | 11/1996 | Nehring | E02D 27/02 | 249/91 |
| 5,596,855 | A * | 1/1997 | Batch | E04C 1/40 | 52/309.11 |
| 6,494,004 | B1 | 12/2002 | Zimmerman | | |

(Continued)

*Primary Examiner* — Beth A Stephan

(74) *Attorney, Agent, or Firm* — Hodgson Russ LLP

(57) ABSTRACT

Herein disclosed are pre-cast concrete wall structures, and processes for manufacturing and installing the same. Wall structure may be wall segments and may comprise a pre-cast concrete monolithic body including a ground-engaging footer and a vertical wall supported by the footer and extending upwardly from the footer. Methods of making wall segments may comprise the steps of providing an initial casting mold, pouring an initial portion of concrete, installing a final casting mold, pouring a final portion of concrete, allowing the initial and final portions of poured concrete to cure to a final hardened state, and removing the initial and final casting molds. Methods of installing wall segments may comprise the steps of excavating the construction site, grading a ground surface at the construction site, positioning a plurality of pre-cast concrete wall segments, interconnecting adjacent wall segments, and backfilling adjacent an exterior side of the foundation wall.

7 Claims, 20 Drawing Sheets

(56) References Cited

U.S. PATENT DOCUMENTS

| | | | | |
|---|---|---|---|---|
| 6,581,343 | B1 * | 6/2003 | Metelli | E04B 7/022<br>403/170 |
| 7,337,591 | B2 * | 3/2008 | Molina | E04G 11/10<br>52/425 |
| 7,530,203 | B1 | 5/2009 | Hare et al. | |
| 9,194,125 | B1 * | 11/2015 | Romanenko | E04B 1/043 |
| 9,523,201 | B2 * | 12/2016 | Romanenko | E04C 1/397 |
| 10,329,767 | B2 * | 6/2019 | Yin | E04B 5/023 |
| 2011/0173911 | A1 * | 7/2011 | Propst | B32B 5/26<br>52/309.13 |

* cited by examiner

PRE-CAST CONCRETE WALL STRUCTURES, AND METHODS FOR MANUFACTURING AND INSTALLING THE SAME

FIELD OF THE DISCLOSURE

The disclosure relates to pre-cast foundation walls, and methods for manufacturing and installing pre-cast foundation walls.

BACKGROUND OF THE DISCLOSURE

Foundation walls are essential in most buildings. A known method of forming a concrete foundation wall involves the following sequential steps: (1) digging an area at a construction site where the foundation wall will be located to an appropriate grade; (2) adding crushed stone to the bottom of the dug-out area to create a level and relatively incompressible grade; (3) installing forms for a footer of the foundation wall; (4) pouring the concrete footer and waiting for the concrete to cure sufficiently; (5) installing forms for vertical walls extending upward from the footer; (6) pouring the concrete vertical walls and waiting for the vertical walls to cure sufficiently; and (7) removing the forms. After the forms have been removed, and following an additional waiting period, backfilling may be done and construction on the superstructure may begin. The method described above is known as "cast-in-place" because the foundation wall is poured and cured at its final intended location on the construction site. The typical "cast-in-place" process from the time the digging and stone grading is complete until the time construction of the superstructure may begin is about four weeks.

The cast-in-place process may be complicated slightly further when drain tile, waterproofing, insulation, or other improvements to the bare wall are to be included. Improvements may be installed during the stages of the process described in the preceding paragraph, but not while the forms are still on the relevant portions of the foundation wall.

A known alternative to cast-in-place foundation walls is the use of pre-cast concrete wall sections, as shown for example in FIG. 1. Pre-cast wall sections are distinguished from cast-in-place walls by the fact that they are poured and formed at a location remote to the construction site, and then transported to the construction site, where they are assembled to provide the foundation walls.

Pre-cast concrete wall sections known to applicant do not have a footer. Thus, the sections do not reliably remain standing on their own in the presence of external factors such as wind and ground settling; in other words, the sections are not "freestanding." This means that if conditions at the job site on the day of installation are not appropriate for installation (for example, rain, snow, and/or high winds are present), the wall sections cannot be safely installed according to schedule. Moreover, the pre-cast wall sections should not be laid down horizontally and left at the job site because they are prone to cracking or failing when rotated between vertical and horizontal orientations.

Consequently, the job site must be prepared for delivery and installation of the pre-cast wall-sections on the scheduled day of installation. Site preparation includes, among other things, digging out the area within which the wall sections will be installed, depositing an appropriate gravel bed, and, depending on whether a footer will be installed, pouring the footer and allowing it to cure. Since the job site must be completely prepared, the dig must align essentially perfectly with where the wall sections are to be installed according to the site plan. Unfortunately, in practice, there are occasions when the dig differs from the site plan by a slight amount. This leads to delays, as the pre-cast wall sections cannot be installed or left at the job site while the builder remedies the faulty site preparation, and delivery and installation must be rescheduled. As a result, the overall cost and duration of construction are increased.

Known pre-cast wall sections additionally suffer from section-to-section connections that are often difficult to connect and are prone to separation. For example, FIG. 2 shows a prior art connection bracket which has failed. Once pre-cast wall sections separate from one another, it is easier for moisture and other harmful natural agents to enter the structure and degrade the foundation. Another drawback of known pre-cast wall sections is that they rely on mitered corners with calking applied at the joint seam, which can lead to separation and infiltration of moisture.

Therefore, pre-cast concrete foundation walls may be improved.

SUMMARY OF THE DISCLOSURE

Herein disclosed are pre-cast concrete wall structures, and processes for manufacturing and installing the same. Such pre-case concrete wall structures may be wall segments.

Some embodiments disclosed herein include a wall segment for constructing a foundation wall of a building. Such wall segments may comprise a pre-cast concrete monolithic body including a ground-engaging footer and a vertical wall supported by the footer and extending upwardly from the footer. The monolithic body may be freestanding.

The monolithic body may include a first end and a second end spaced from one another in a longitudinal direction of the monolithic body. The vertical wall may extend longitudinally beyond the footer at the first end. The footer may extend longitudinally beyond the vertical wall at the second end.

The vertical wall may include an interior face and an exterior face spaced from one another in a lateral direction of the monolithic body. The footer may extend laterally beyond the interior face and the exterior face of the vertical wall.

The vertical wall may include a tongue and a groove. The vertical wall may include a tongue at one of the first and second ends of the monolithic body. The vertical wall may include a groove at the other of the first and second ends of the monolithic body. The tongue may be at the first end and the groove may be at the second end. One of the tongue and the groove may be formed in the interior face of the vertical wall. The groove may be formed in the interior face. The tongue may be formed at the first end of the monolithic body.

The wall segment may further comprise a plurality of connection brackets. A portion of each connection bracket may be embedded in the monolithic body. One of the plurality of connection brackets may be located at the first end of the monolithic body. Another of the plurality of connection brackets may be located at the second end of the monolithic body.

The wall segment may further comprise a pair of identical connection brackets. A portion of each connection bracket may be embedded in the monolithic body. The pair of connection brackets may include a first connection bracket having an outer face flush with an outer surface of the tongue. The pair of connection brackets may also include a second connection bracket having an outer face flush with an inner face of the groove.

Further embodiments disclosed herein include methods of manufacturing a pre-cast concrete wall segment for use in a building foundation. The wall segment may include a ground-engaging footer and a vertical wall supported by the footer and extending upwardly from the footer. Such methods may comprise the steps of providing an initial casting mold, pouring an initial portion of concrete, installing a final casting mold, pouring a final portion of concrete, allowing the initial and final portions of poured concrete to cure to a final hardened state, and removing the initial and final casting molds.

The initial casting mold may include a first region for forming the vertical wall in a horizontal orientation and a second region contiguous with the first region for forming an initial portion of the footer. The second region may be deeper than the first region.

The initial portion of concrete may be poured from a batch of concrete into the initial casting mold to fill the first and second regions of the initial casting mold. The initial portion of concrete may have an initial pour level.

The final casting mold may be installed on the second region of the initial casting mold. The final casting mold may define a third region contiguous with the second region for forming a final portion of the footer.

The final portion of concrete may be poured from the batch of concrete into the final casting mold to fill the third region defined by the final casting mold. The final portion of concrete may have a final pour level above the initial pour level.

The method may further comprise the step of waiting for a predetermined period of time between pouring the initial portion of concrete and pouring the final portion of concrete.

The method may further comprise the step of adding a plasticizer to the batch of concrete.

The method may further comprise the step of embedding a portion of a connection bracket into at least one of the initial and final portions of poured concrete before the initial and final portions of poured concrete reach the final hardened state.

Further embodiments disclosed herein include methods of installing a foundation wall at a construction site. Such methods may comprise the steps of excavating the construction site, grading a ground surface at the construction site, positioning a plurality of pre-cast concrete wall segments at a target location on the ground surface, interconnecting adjacent wall segments of the plurality of pre-cast concrete wall segments using connection brackets, and backfilling adjacent an exterior side of the foundation wall.

Each of the plurality of pre-cast concrete wall segments may comprise a monolithic body. Each monolithic body may include a ground-engaging footer and a vertical wall supported by the footer and extending upwardly from the footer. Each monolithic body may be freestanding upon the ground surface.

The plurality of pre-cast concrete wall segments may be positioned such that an end portion of the footer of each wall segment supports an end portion of the vertical wall of an adjacent wall segment.

The plurality of pre-cast concrete wall segments may be positioned such that the vertical wall of each wall segment mates tongue-in-groove with a vertical wall of an adjacent wall segment.

The steps of positioning and backfilling may be performed on different days.

BRIEF DESCRIPTION OF THE FIGURES

For a fuller understanding of the nature and objects of the disclosure, reference should be made to the following detailed description taken in conjunction with the accompanying drawings, in which.

DETAILED DESCRIPTION OF THE DISCLOSURE

Figure 1:
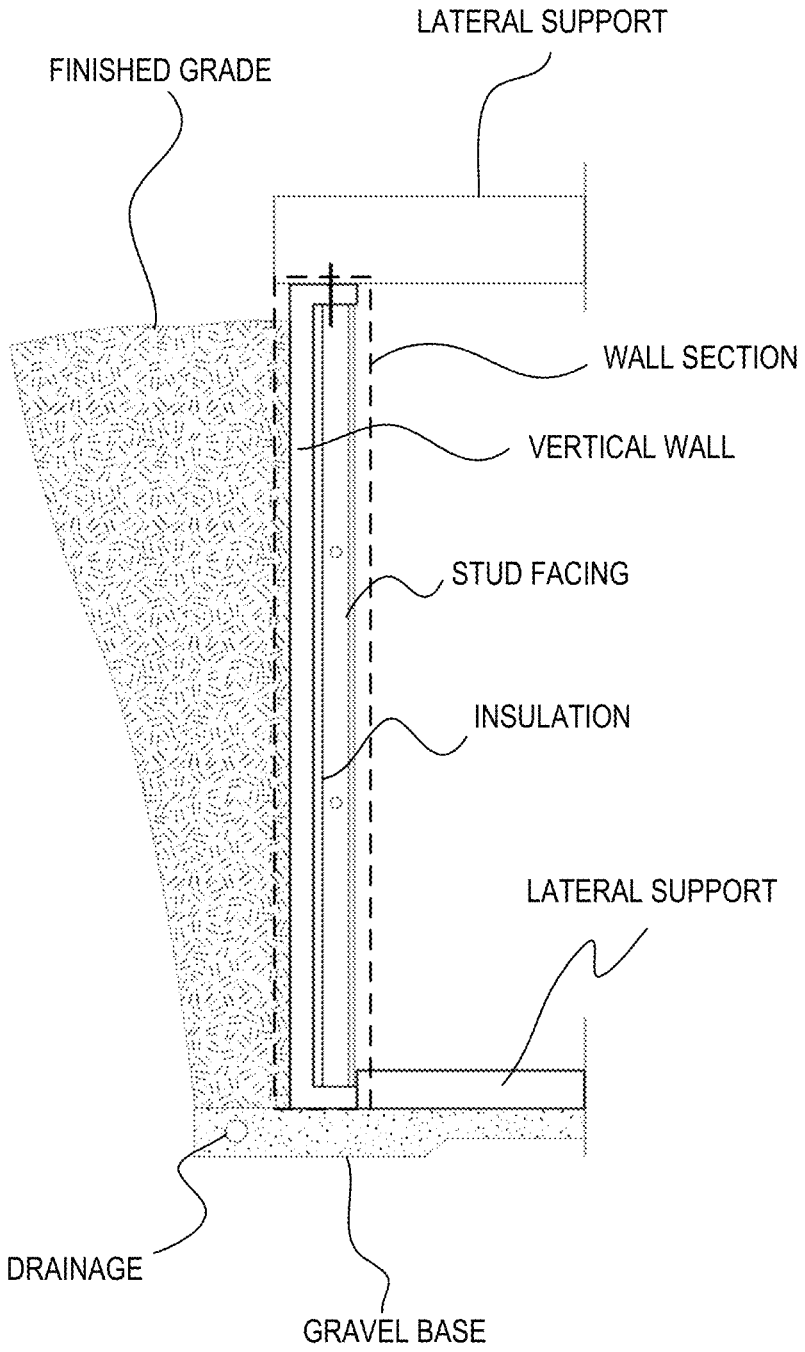
FIG. 1 (PRIOR ART)
FIG. 1 is an end elevation view of a pre-cast concrete wall segment according to the prior art, as installed at a job site.
Figure 2:
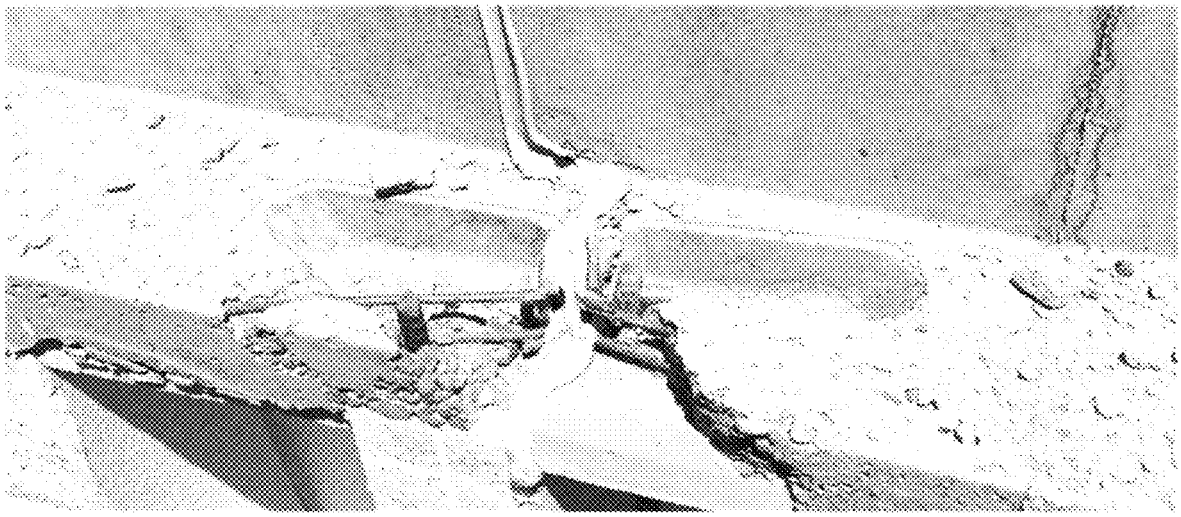
FIG. 2 (PRIOR ART)
FIG. 2 is a perspective view showing a failed connection bracket of the prior art used to connect adjacent pre-cast concrete wall sections according to the prior art.
Figure 3:
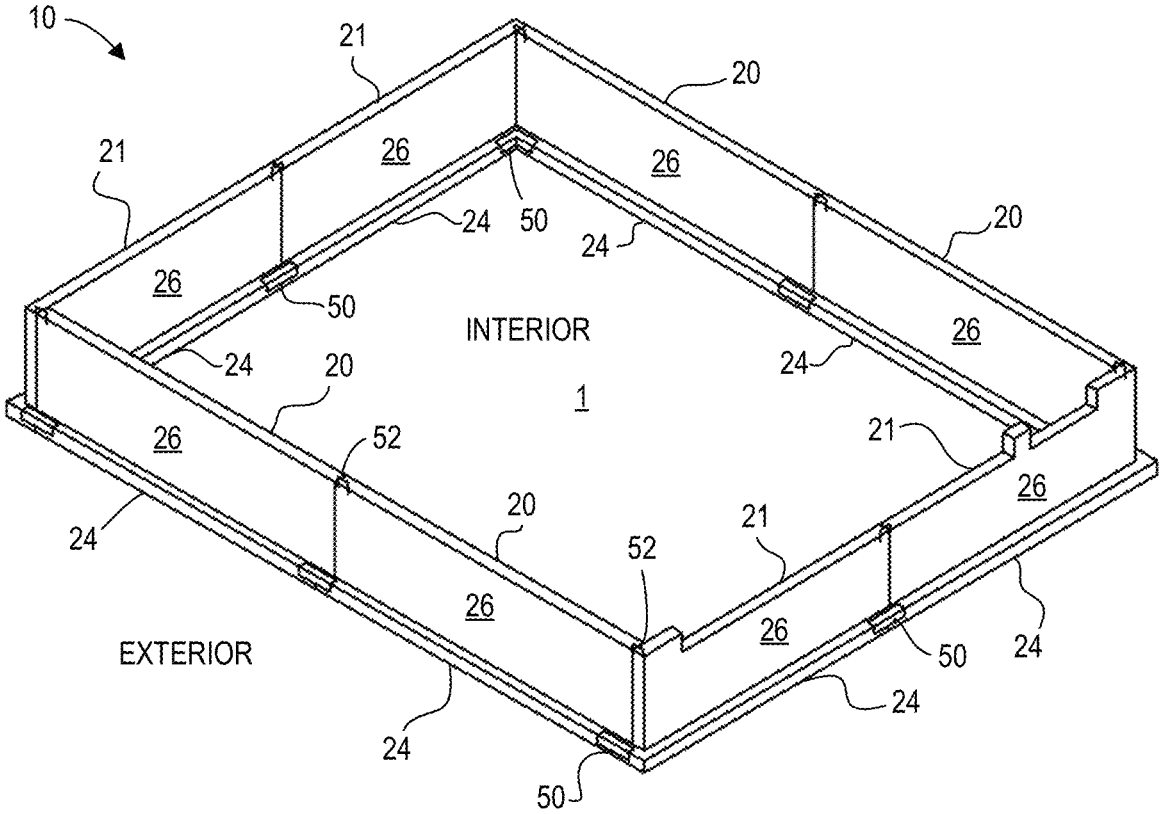
FIG. 3 is a perspective view of a foundation wall assembly formed according to an embodiment of the present disclosure.
Figure 4:
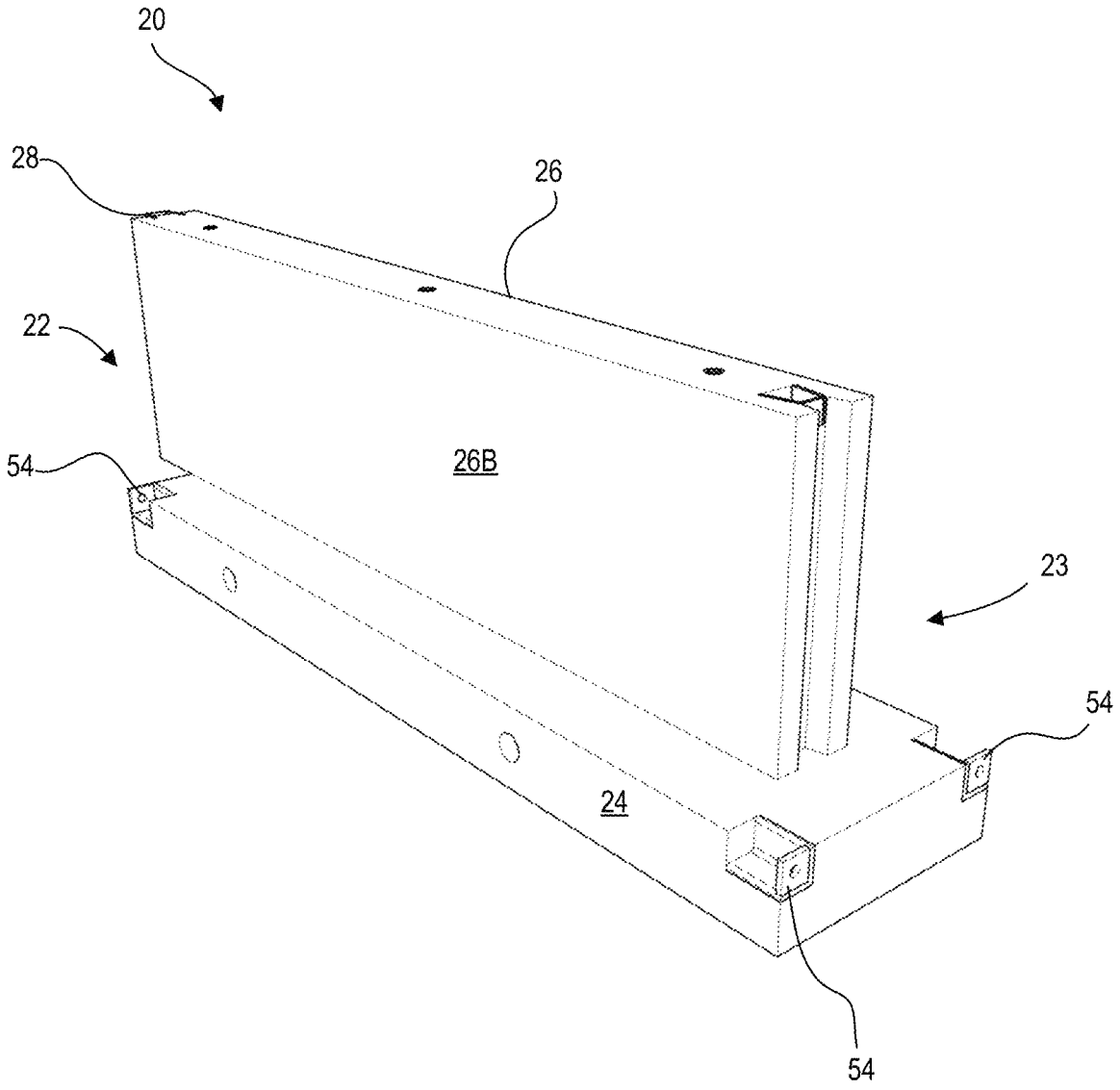
FIG. 4 is a perspective view of a pre-cast concrete straight-line wall segment according to an embodiment of the present disclosure.

FIG. 3 shows a foundation wall 10 formed according to an embodiment of the present disclosure by assembling a plurality of pre-cast concrete wall segments 20 and 21 positioned on ground 1 at a construction site. Wall segments 20 are referred to herein as straight-line wall segments, and wall segments 21 are referred to herein as corner wall segments. Each wall segment 20, 21 comprises a pre-cast concrete monolithic body including a ground-engaging footer 24 and a vertical wall 26 supported by the footer and extending upwardly from the footer. Footer 24 is wider than vertical wall 26 in a lateral direction of the wall segment, i.e. an interior-to-exterior direction as seen in FIG. 3, whereby the monolithic body of the wall segment is freestanding. As shown in the depicted embodiment, footer 24 may extend laterally beyond an interior side face of vertical wall 26 toward the interior of foundation wall 10, and may also extend laterally beyond an exterior side face of vertical wall 26 toward the exterior of foundation wall 10, such that the wall segment 20, 21 is stable and resists tipping in either lateral direction. Wall segments 20, 21 may be interconnected with one another using connection brackets to join adjacent wall segments. For example, in the depicted embodiment, angle brackets 50 may be used to connect end portions of the footers 24 of adjacent wall segments, and U-bar brackets 52 may be used to connect end portions of the vertical walls 26 of adjacent wall segments. Wall segments 20, 21 may have different lengths, and the number of wall segments 20, 21 used in assembling foundation wall 10 may vary. Wall segments 20, 21 may include one or more weep holes 25 extending through footer 24 from an interior side of the wall segment to an exterior side of the wall segment to facilitate drainage and breathability between the interior and exterior of foundation wall 10.

Further reference will now be made to FIGS. 4-10 for describing an embodiment of straight-line wall segment 20 in greater detail. The monolithic body of wall segment 20 includes a first end 22 and a second end 23 spaced from one another in a longitudinal direction of the monolithic body, wherein vertical wall 26 extends longitudinally beyond footer 24 at first end 22 and footer 24 extends longitudinally beyond vertical wall 26 at second end 23. By offsetting the vertical wall 26 and footer 24 in this manner, straight-line wall segment 20 may be positioned end-to-end with another wall segment such that an end portion of vertical wall 26 will overlap with and be supported by an opposing end portion of the footer 24 of the other wall segment. This configuration may be understood from FIGS. 9 and 10. In one embodiment, a longitudinal distance D1 that vertical wall 26 extends beyond footer 24 at first end 22 may be equal to a longitudinal distance D2 that footer 24 extends beyond vertical wall 26 at second end 23, and this distance may be kept constant for all straight-line wall segments 20 used in assembling foundation wall 10 so that the vertical wall 26 of a given wall segment 20 will engage with the vertical wall 26 of an adjacent wall segment.

Vertical wall 26 includes an interior face 26A and an exterior face 26B spaced from one another in a lateral direction of the monolithic body, and footer 24 may extend laterally beyond interior face 26A and exterior face 26B. This provides stability so that the monolithic body of wall segment 20 is freestanding on its own in all weather conditions in the absence of backfill or temporary supports. In the depicted embodiment, footer 24 has the shape of a rectangular cuboid, and a top surface 24A of footer 24 is exposed at second end 23. Footer 24 may have a shape other than that of a rectangular cuboid. For example, footer 24 may have the shape of a trapezoidal prism, such as an isosceles trapezoidal prism.

Figure 9:
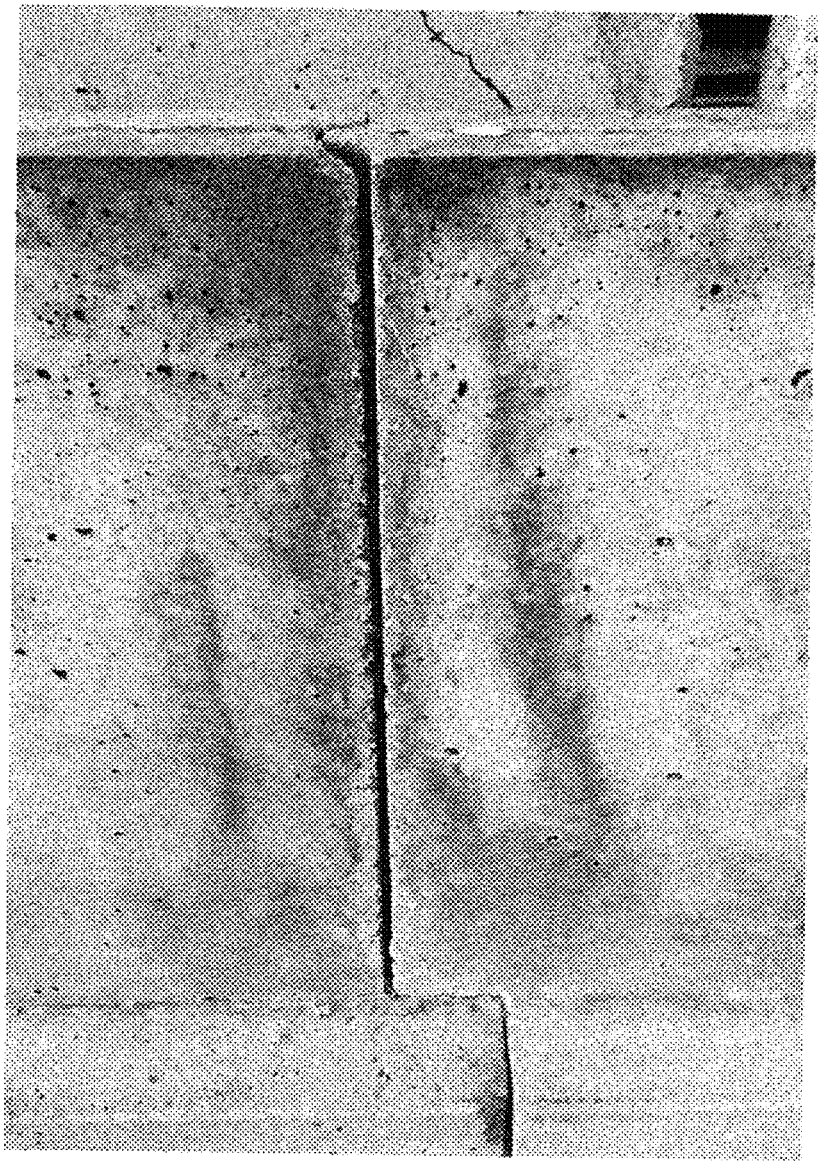
FIG. 9 is a perspective view illustrating end-to-end fitted engagement of two adjacent straight-line wall segments according to an embodiment of the present disclosure.
Figure 10:
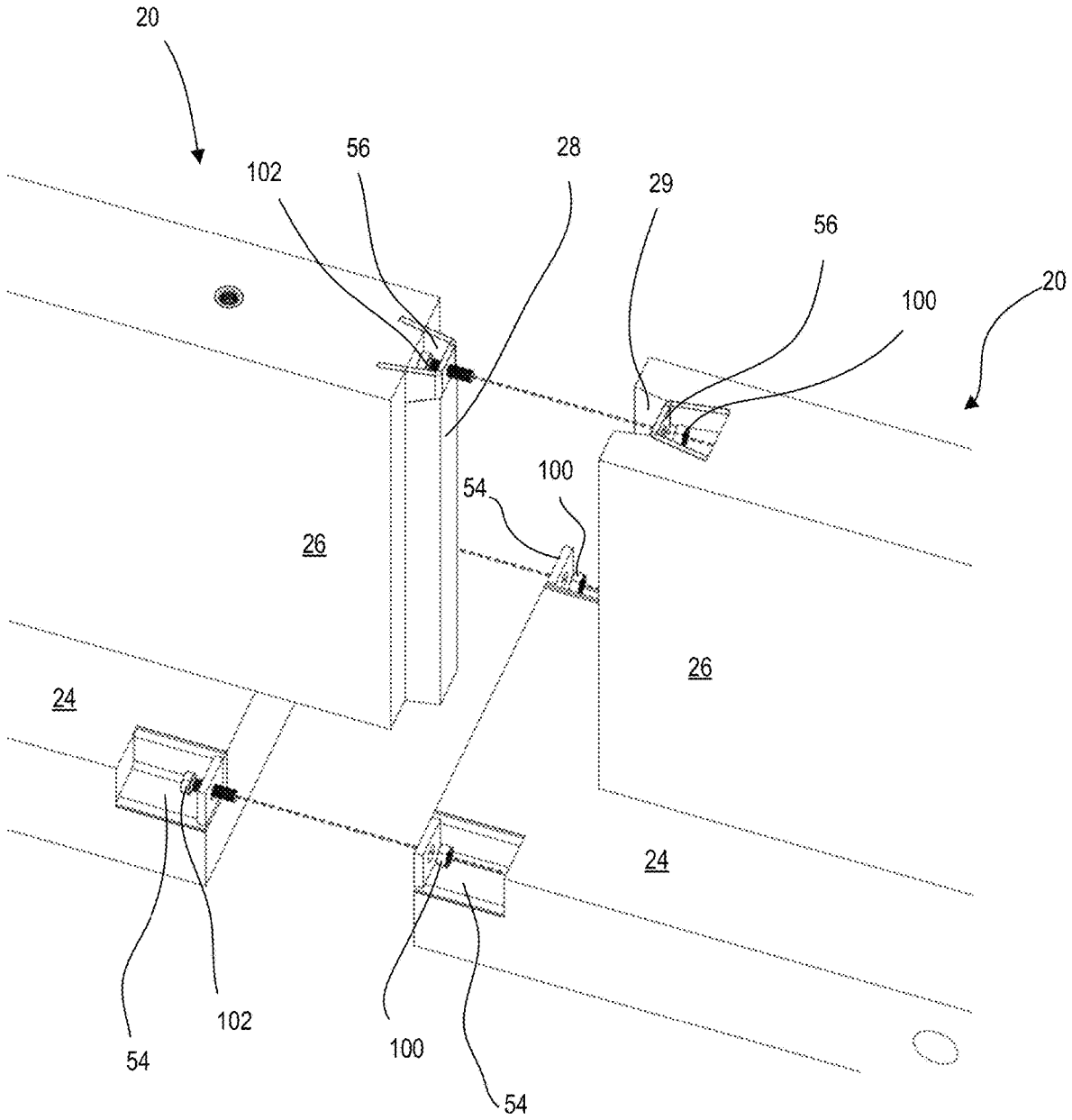
FIG. 10 is a perspective view illustrating end-to-end connection of two straight-line wall segments according to an embodiment of the present disclosure using footer connection brackets and wall connection brackets as shown in FIGS. 7 and 8.

The monolithic pre-cast body of straight-line wall segment 20 may be formed such that vertical wall 26 includes a tongue 28 at one of the first and second ends 22, 23 of the monolithic body, and vertical wall 26 includes a groove 29 at the other of the first and second ends of the monolithic body. Tongue 28 and groove 29 are sized such that the vertical wall 26 of one wall segment 20 may be brought into mating engagement with the vertical wall 26 of another wall segment 20 wherein the tongue 28 of one wall segment is received in the groove 29 of the other wall segment as depicted in FIG. 9. In the illustrated embodiment, tongue 28 is at first end 22 and groove 29 is at second end 23, however the end positions of tongue 28 and groove 29 may be reversed. Tongue 28 and groove 29 may have a trapezoidal shape in top plan view to facilitate insertion of tongue 28, as illustrated in FIG. 10, into groove 29. In determining the offset distances D1 and D2 mentioned above, tongue 28 and groove 29 may be disregarded.

Wall segment 20 may further comprise a plurality of connection brackets 54, 56 for use in attaching adjacent wall segments 20 to one another, wherein a portion of each connection bracket 54, 56 is embedded in the pre-cast monolithic body of segment 20. At least one connection bracket 54, 56 may be located at first end 22 of the monolithic body, and at least one other connection bracket 54, 56 may be located at second end 23 of the monolithic body. In the illustrated embodiment, connection brackets 54 are embodied as footer connection brackets partially embedded in footer 24, and connection brackets 56 are embodied as wall connection brackets partially embedded in vertical wall 26.

Figure 7:
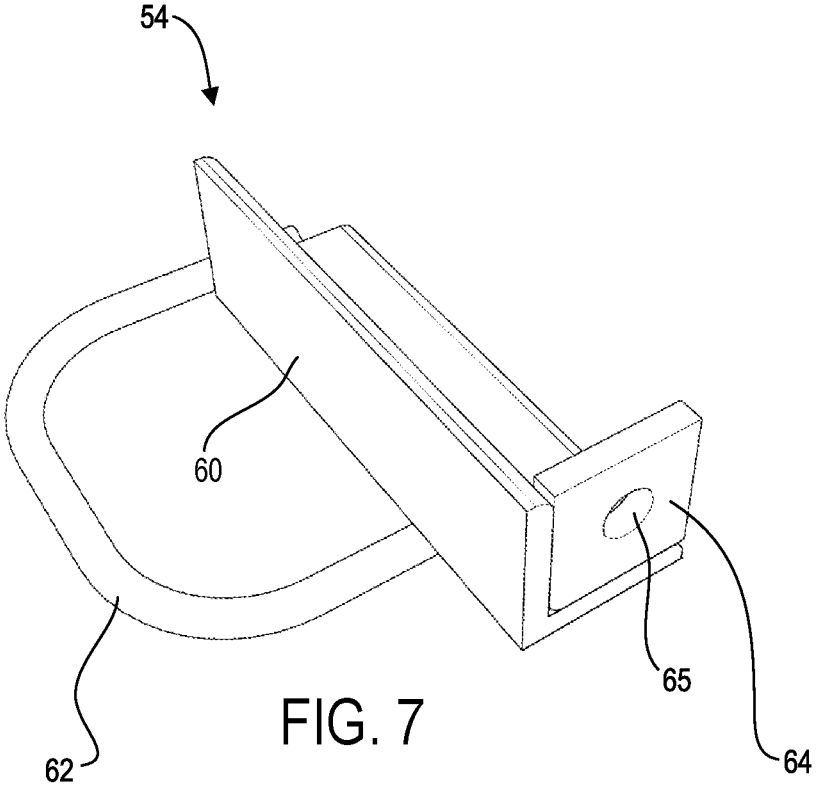
FIG. 7 is a perspective view of a footer connection bracket according to an embodiment of the present disclosure.

FIG. 7 shows footer connection bracket 54 in greater detail. Footer connection bracket 54 may be formed of metal and may include an angle piece 60, an anchor bar 62 fixed to and extending laterally from angle piece 60, and an end plate 64 fixed at an end of angle piece 60 and having a fastener hole 65 therethrough. Footer connection bracket 54 may be a welded assembly. In the embodiment shown in the figures, four footer connection brackets 54 are located one at each corner of footer 24 such that the end plate 64 of each footer bracket 54 is flush with an end face of footer 24 and the anchor bar 62 of each footer bracket 54 is embedded in footer 24. As may be understood, footer connection brackets 54 on an interior side of wall segment 20 are configured as a mirror-image of footer connection brackets 54 on an exterior side of wall segment 20. Footer connection brackets 54 may be located at the top of footer 24, and an internal region defined by angle piece 60 and end plate 64 may be left void of concrete, so that threaded fasteners (e.g. a nut 100 and a bolt 102) may be installed across opposing footer connection brackets 54 as illustrated in FIG. 10.

Figure 5:
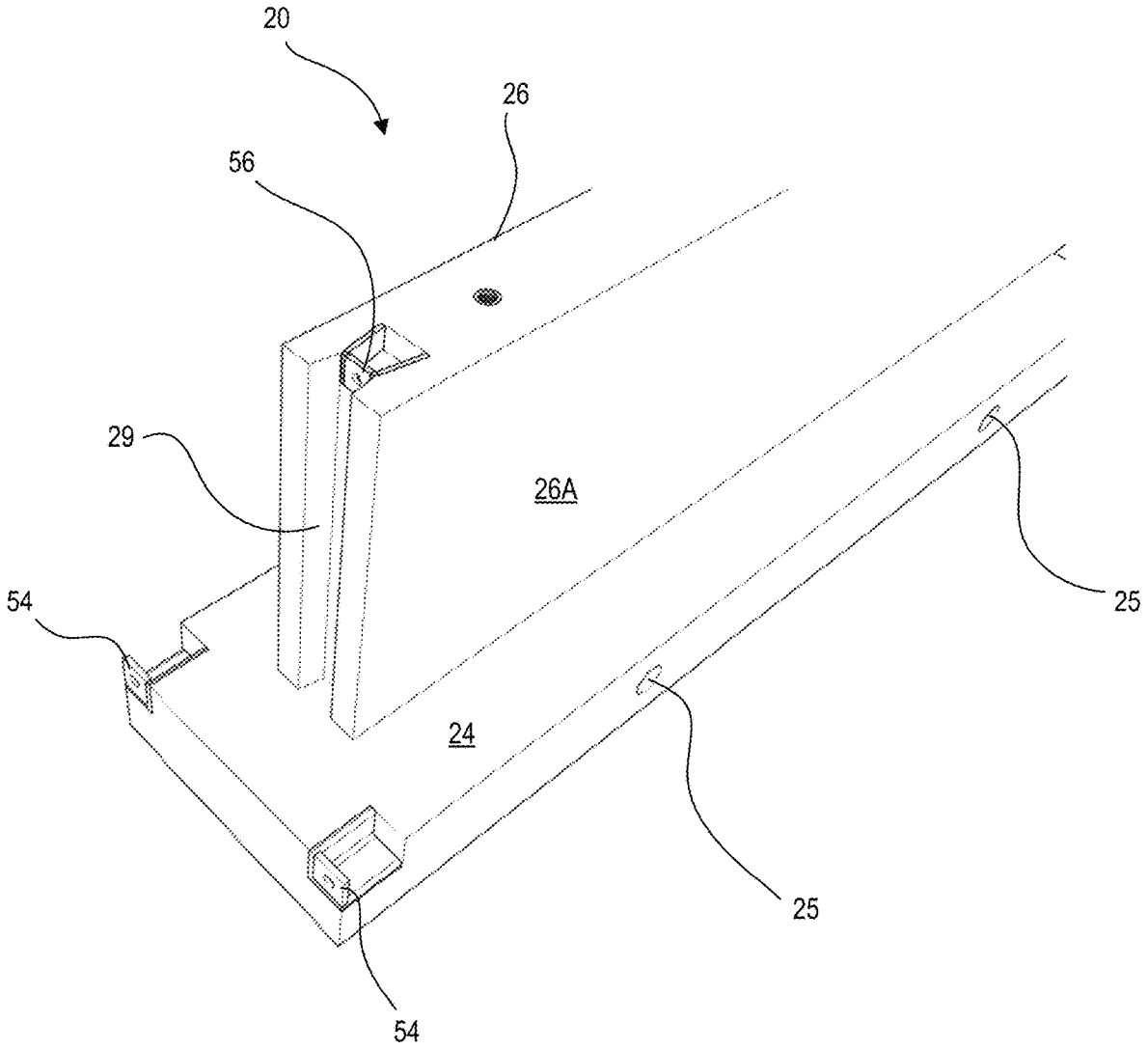
FIG. 5 is a perspective view showing a first end portion of the straight-line wall segment shown in FIG. 4, wherein a concrete body of the wall segment is shown in phantom line to illustrate a wall connection bracket according to an embodiment of the present disclosure.
Figure 6A:
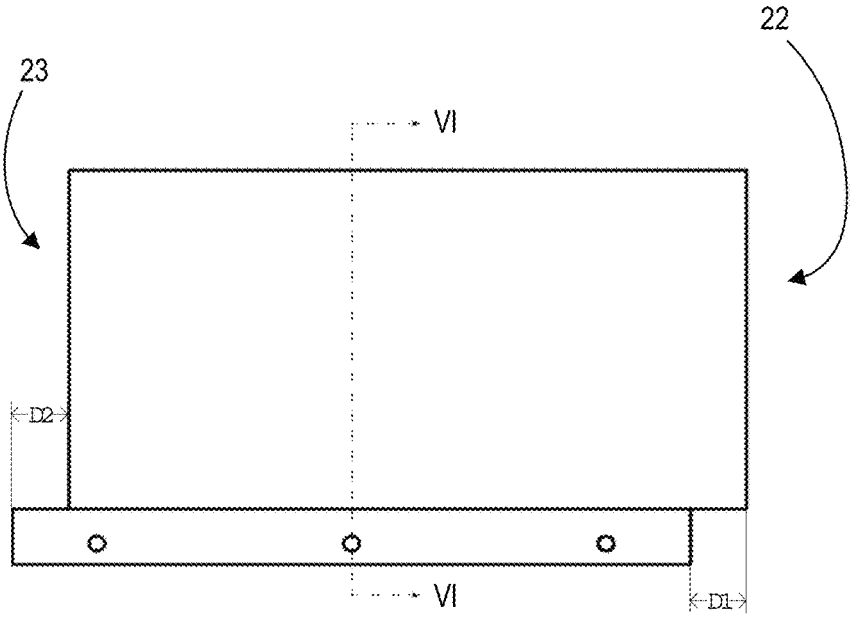
FIG. 6A is a side elevation view of a monolithic body of the straight-line wall segment shown in FIG. 4.
Figure 6B:
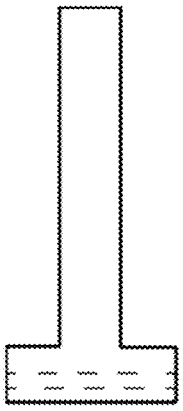
FIG. 6B is a cross-sectional view of the monolithic body taken generally along the line VI-VI in FIG. 6A.
Figure 8:
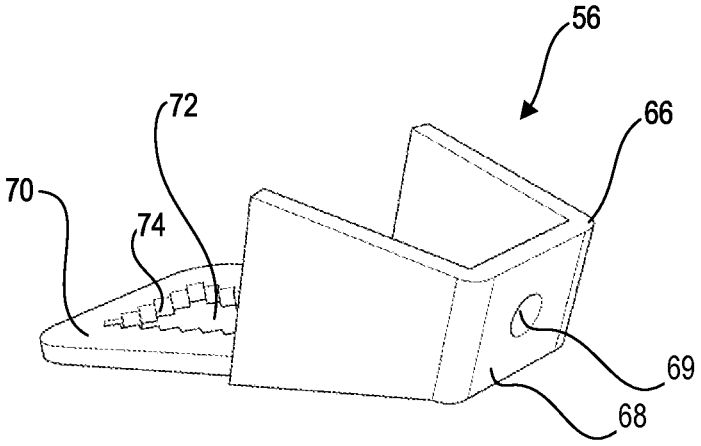
FIG. 8 is a perspective view of a wall connection bracket according to an embodiment of the present disclosure.

FIG. 8 shows wall connection bracket 56 in greater detail. In an embodiment of the present disclosure, at least one wall connection bracket 56 is associated with tongue 28 and at least one other wall connection bracket 56 is associated with groove 29. Wall connection bracket 56 may comprise a frame 66 including an end wall 68 having a fastener hole 69 therethrough. In the depicted embodiment, frame 66 may have three walls forming a trapezoidal external shape corresponding in size and shape to an external shape of tongue 28. Wall connection bracket 56 may further comprise an anchor plate 70 fixed to an internal region of frame 66 and extending beyond the internal region of frame 66. At least a portion of anchor plate 70 is embedded in vertical wall 26, and may include a gap 72 which may bounded by a serrated edge 74 to improve anchoring integrity and strength when anchor plate is embedded in vertical wall 26. As may be understood from FIG. 5, wall connection bracket 56 may be arranged differently depending upon whether it is associated with tongue 28 or with groove 29. For example, when wall connection bracket 56 is associated with groove 29, as shown in FIG. 5, an outer face of end wall 68 is arranged such that it is flush with an inner face of groove 29, and when wall connection bracket 56 is associated with tongue 28, the outer face of end wall 68 is arranged such that it is flush with an outer face of tongue 28. As will be appreciated, identical wall connection brackets 56 may be used at either end of the monolithic body, offering economic advantage in manufacturing only one type of wall connection bracket. Wall connection brackets 56 may be located at the top of vertical wall 26, and the internal region of frame 66 may be left void of concrete, so that threaded fasteners (e.g. a nut 100 and a bolt 102) may be installed across opposing wall connection brackets 56 as illustrated in FIG. 10.

Figure 11:
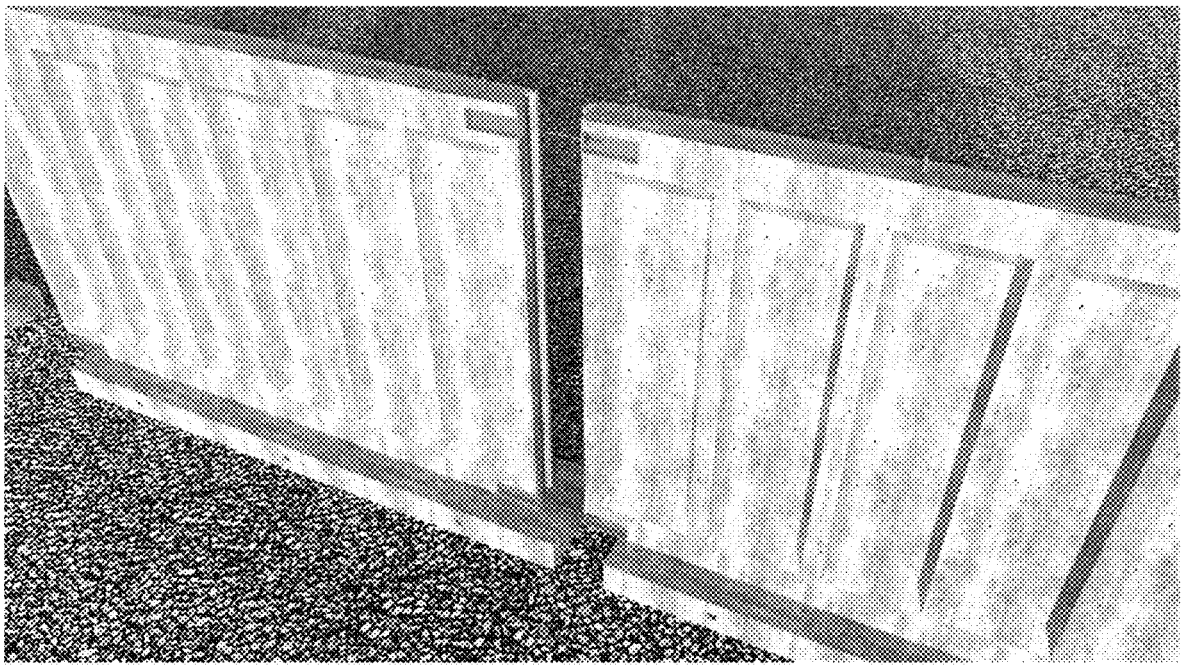
FIG. 11 is a perspective view illustrating end-to-end connection of two straight-line wall segments according to another embodiment of the present disclosure using connection brackets having an alternative configuration.

FIG. 11 illustrates end-to-end connection of two straight-line wall segments 20 according to another embodiment of the present disclosure using connection brackets having an alternative configuration. In the embodiment of FIG. 11, rectangular box brackets 80 are placed near the top and bottom of vertical wall 26 on both sides of each wall segment 20. Each box bracket 80 provided a fastener hole and void region four receiving threaded fasteners.

Figure 12A:
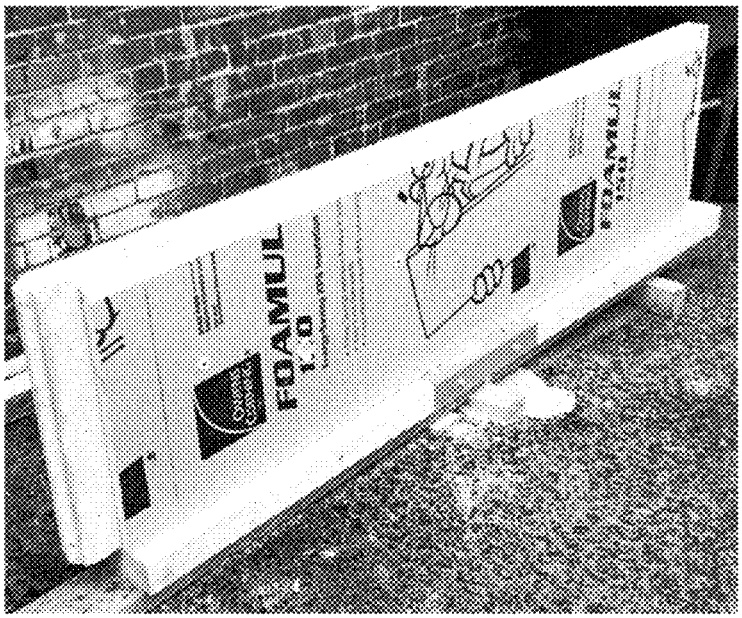
FIG. 12A is a perspective view illustrating end-to-end connection of two straight-line wall segments according to a further embodiment of the present disclosure using connection brackets having another alternative configuration, wherein a panel of insulation is attached to the connected wall segments.
Figure 12B:
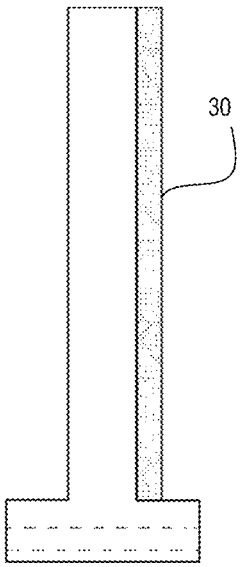
FIG. 12B is cross-sectional view illustrating a wall segment as shown in FIG. 12A having an attached insulation panel.

FIG. 12A shows end-to-end connection of two straight-line wall segments 20 using an angle bracket 50 attached to the footer 24 of each wall segment 20, for example using concrete anchors or another suitable type of fastener. As shown in FIG. 12A, and as further illustrated in the cross-sectional view of FIG. 12B, wall segment 20 may further comprise a thermal insulation layer 30 on at least an interior side of vertical wall 26. For example, thermal insulation layer 30 may be provided by affixing one or more panels of rigid insulation material to a side face of vertical wall 26. The rigid panel or panels may be affixed by applying the panel or panels to the concrete as the concrete is curing during the casting process, or by using fasteners and/or adhesives after the monolithic concrete body has cured.

Figure 13A:
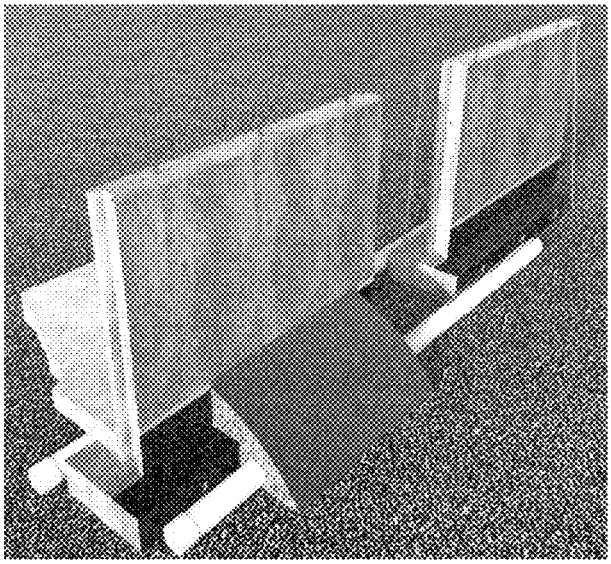
FIG. 13A is a perspective view of wall segments having an integrated drainage system according to anther embodiment of the present disclosure.
Figure 13B:
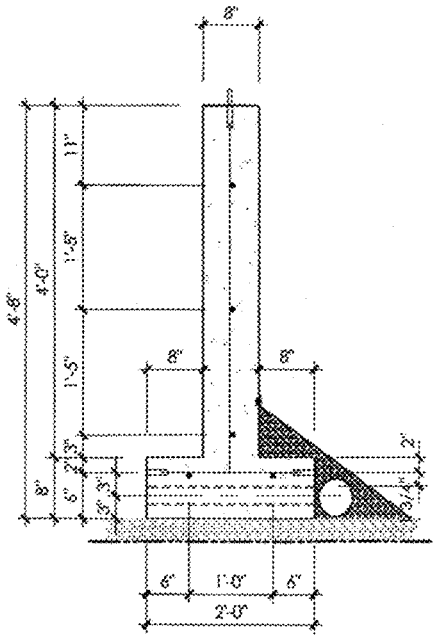
FIG. 13B is a cross-sectional view illustrating the integrated drainage system shown in FIG. 13A.
Figure 14:
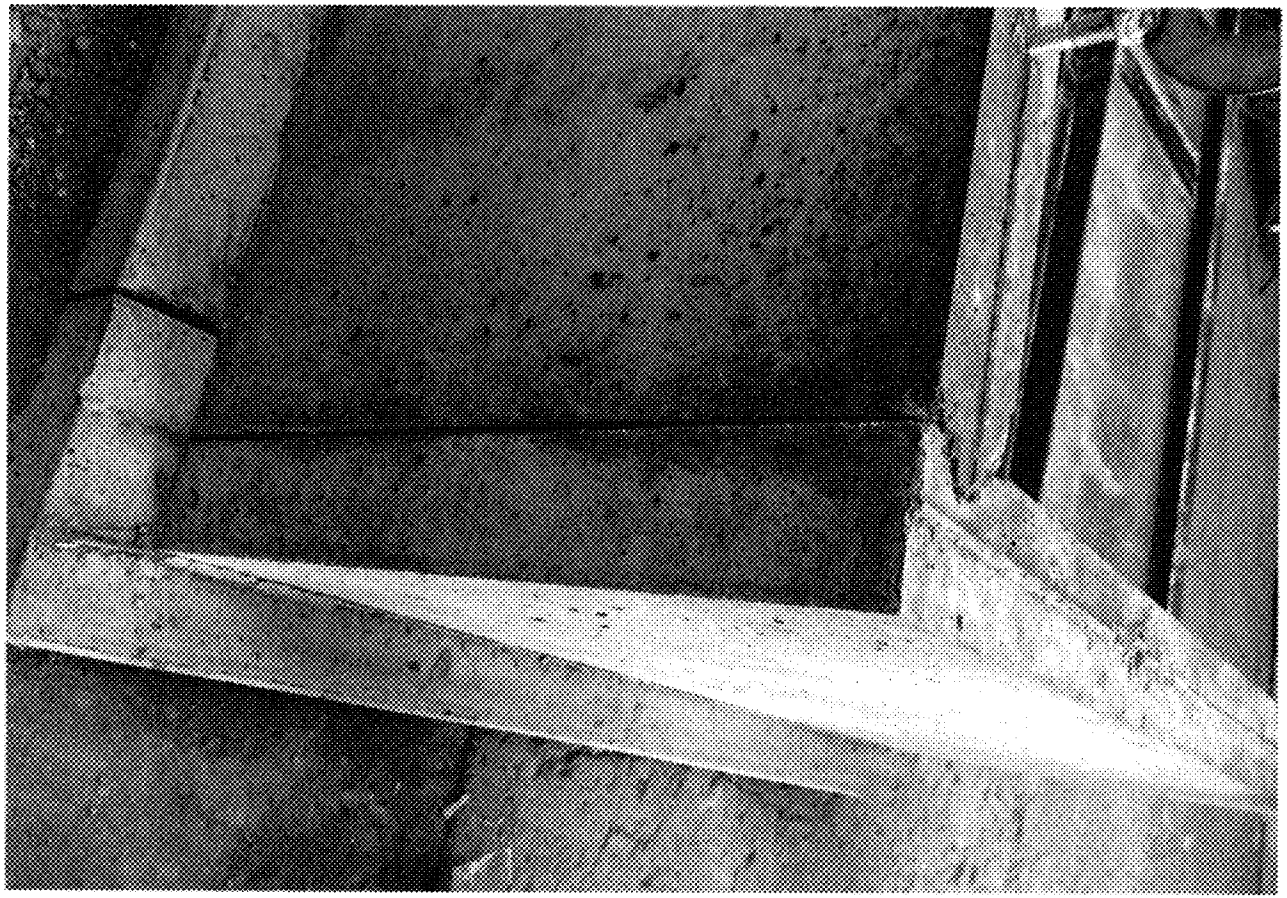
FIG. 14 is an exterior perspective view showing a corner portion of a foundation wall assembly formed according to an embodiment of the present disclosure.

FIGS. 13A and 13B illustrate another embodiment of the present disclosure wherein wall segments 20 comprise an integrated drainage system 90. Referring back to FIG. 4, wall segment 20 may include a plurality of lifting attachment fixtures 40 embedded in or attached to the top of vertical wall 26. For example, attachment fixture 40 may be embodied as a threaded sleeve or coupling nut embedded in vertical wall 26 for temporarily receiving an anchor eye-bolt (not shown) which can be used to attach a lifting harness to the wall segment so that the wall segment may be lifted and positioned using heavy machinery. As another example, attachment fixture 40 may be embodied as an anchor bolt directly secured in a drilled hole in vertical wall 26.

Figure 15:
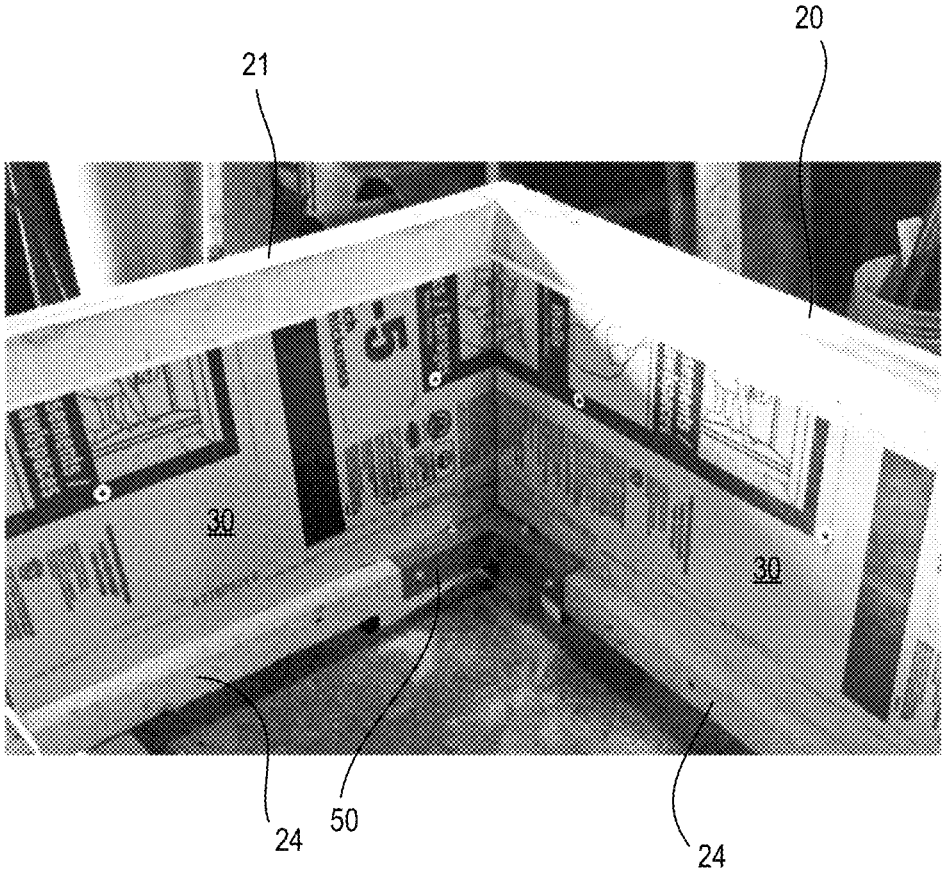
FIG. 15 is an interior perspective view showing a corner portion of a foundation wall assembly formed according to an embodiment of the present disclosure.
Figure 16:
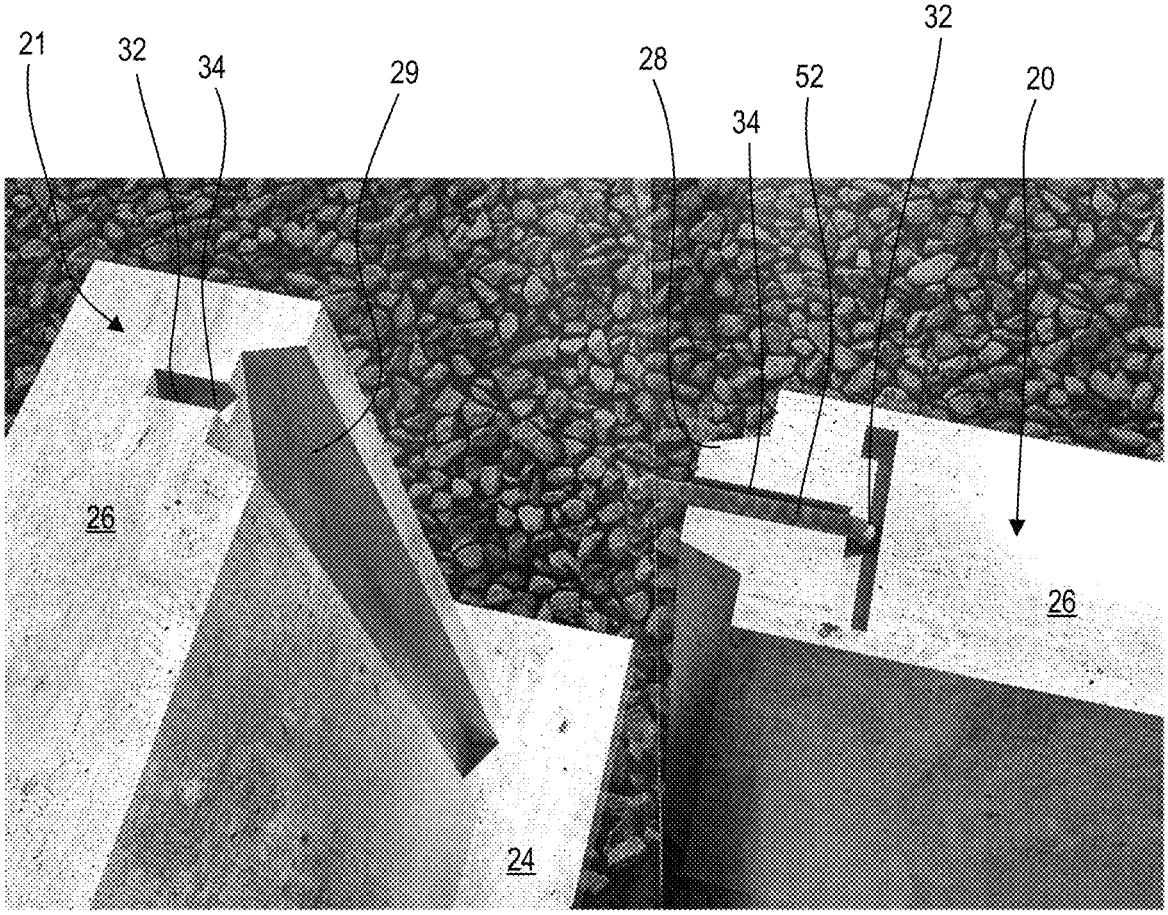
FIG. 16 is a close-up perspective view illustrating mating of a straight-line wall segment with a corner wall segment according to an embodiment of the present disclosure.
Figure 17:
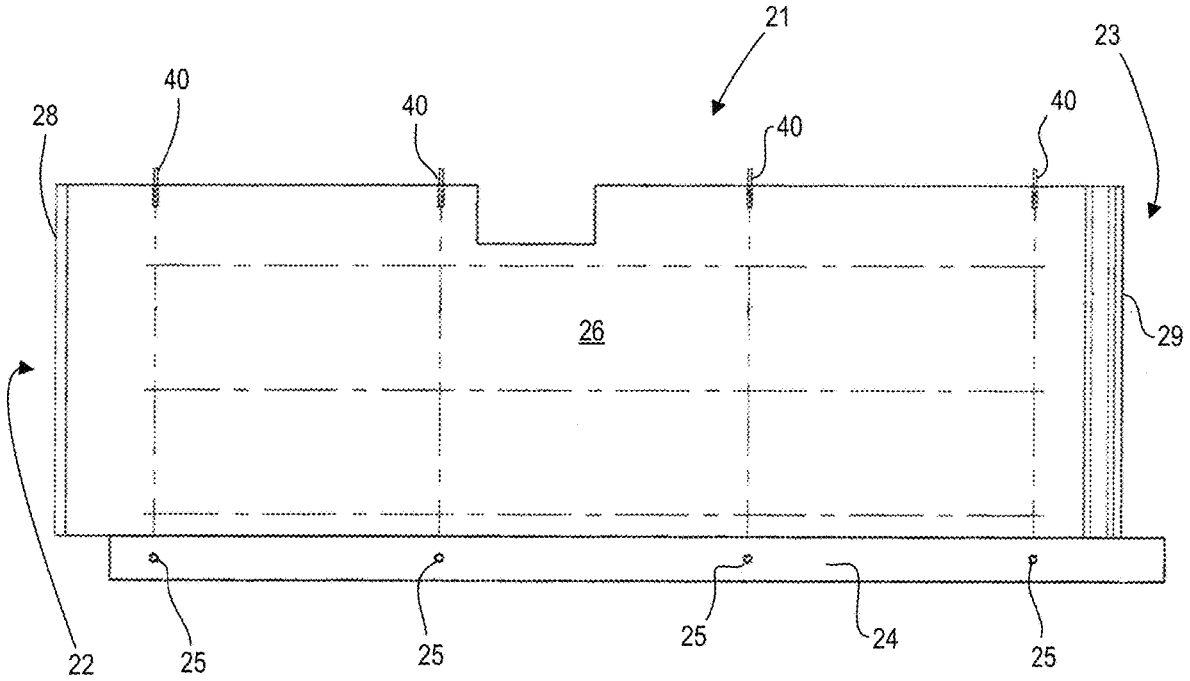
FIG. 17 is a side elevation view of the corner wall segment shown in FIG. 16.
Figure 18:
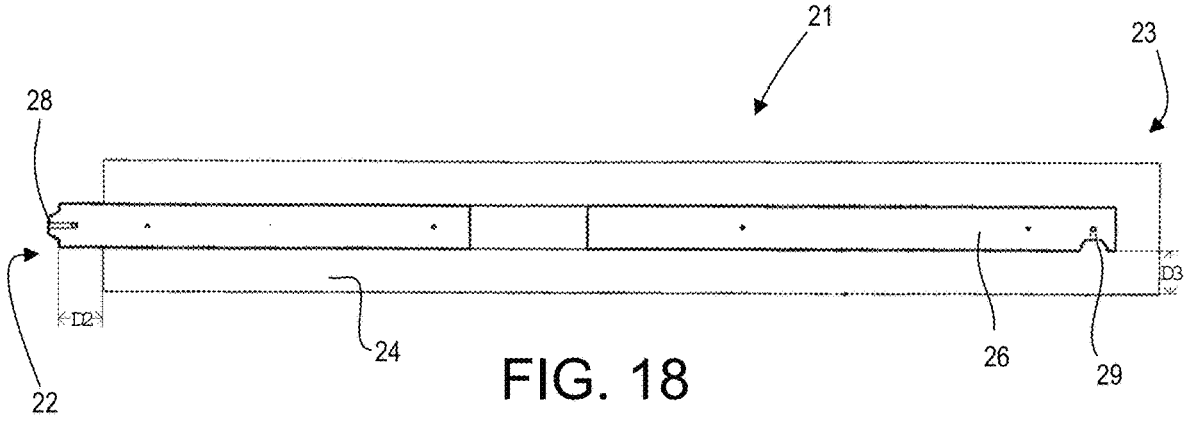
FIG. 18 is a top plan view of the corner wall segment shown in FIG. 16.

Reference will now be made to FIGS. 14-18 for describing an embodiment of corner wall segment 21 in greater detail. Corner wall segment 21 may be substantially similar to straight-line wall segment 20 described above, except that second end 23 is modified such that groove 29 is formed in the interior face of vertical wall 26 to receive the tongue 28 of another wall segment, such as a straight-line wall segment 20, positioned at an angle to corner wall segment 21. In the illustrated embodiment, the angle is a right angle (ninety degrees), however it is conceivable to alter the configuration of second end 23 to provide for other corner angles. Alternatively, a corner wall segment may be provided by modifying first end 22 such that such that tongue 28 is formed in the interior face of vertical wall 26 to mate with the groove 29 of another wall segment positioned at an angle to the corner wall segment. As shown in FIG. 15, corner wall segment 21 may be joined with another wall segment by an angle bracket 50 connecting the respective footers 24 of the adjacent wall segments. FIG. 16 illustrates the use of a U-bar bracket 52 to connect the respective vertical walls 26 adjacent wall segments 20, 21 at a corner junction. As may be seen, the monolithic body of each wall segment may be provided with holes 32 and recessed channels 34 for receiving U-bar bracket 52. Of course, footer connection brackets 54 and wall connection brackets 56 described above may be positioned in corner wall segment 21 for connecting corner wall segment 21 to another wall segment.

In the illustrated embodiment, a transverse distance D3 that footer 24 extends beyond the interior face of vertical wall 26 at second end 23 may be equal to a longitudinal distance D1 that vertical wall 26 extends beyond footer 24 at first end 22, and this distance may be kept constant for all corner wall segments 21 used in assembling foundation wall 10 so that the vertical wall 26 of a given corner wall segment 21 will engage with the vertical wall 26 of an adjacent wall segment. In determining the offset distances D1 and D3, tongue 28 and groove 29 may be disregarded. As will be understood, wall segments 20, 21 may be dimensioned in a standardized way to fit together in an overlapping manner providing tight seams between adjacent wall segments.

Any dimensional ranges indicated herein for wall segments are merely for sake of example, and do not define any upper or lower dimensional limits applicable to wall segments.

Figure 19:
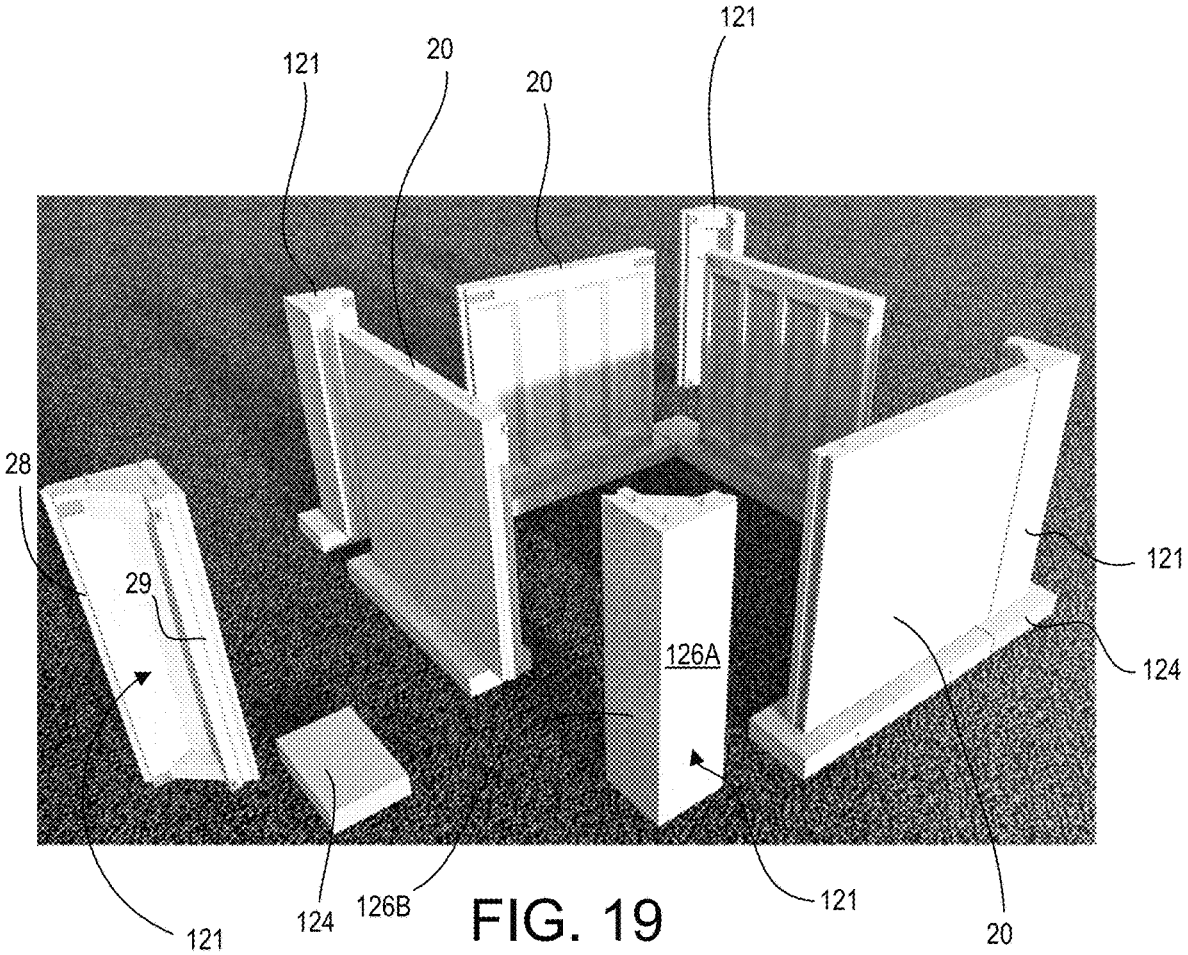
FIG. 19 is a perspective view showing a plurality of pre-cast concrete wall segments, including corner wall segments formed according to an alternate embodiment of the present disclosure.

FIG. 19 illustrates a corner wall segment 121 according to an alternate embodiment of the present disclosure. Corner wall segment 121 includes a vertical wall having vertical wall portions 126A and 126B forming a corner angle, wherein one of the vertical wall portions includes a tongue 28 and the other vertical wall portion includes a groove 29. A separately cast pedestal 124 may be used in place of an integrally cast footer to support corner wall segment 121 on the ground and engage with footers 24 of adjacent straight-line wall segments 20.

Pre-cast wall segments 20, 21, 121 may have an arrangement of rebar (not shown) embedded within the monolithic concrete body thereof. In this way, there may be a lattice or other appropriate pattern of rebar embedded within the concrete to provide added strength and structural integrity to the wall segment.

Figure 20:
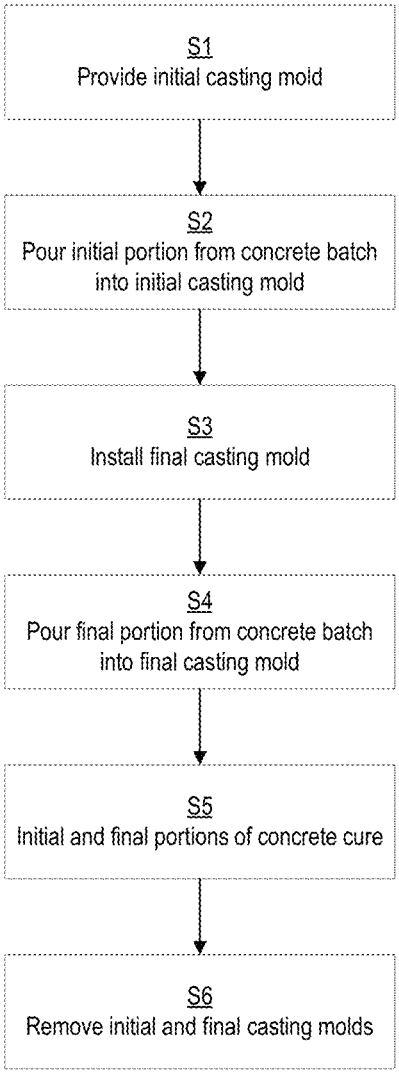
FIG. 20 is a flow diagram illustrating a method of making a pre-cast concrete wall segment according to an embodiment of the present disclosure.
Figure 21A:
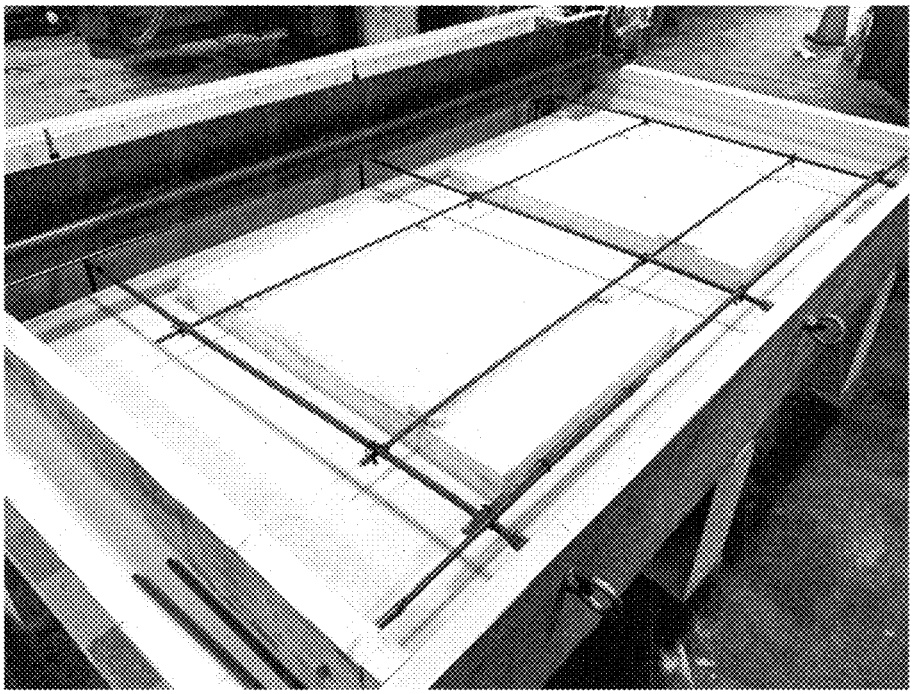
FIG. 21A is a perspective view of an embodiment of an initial casting mold usable in the method illustrated in FIG. 20.
Figure 21B:
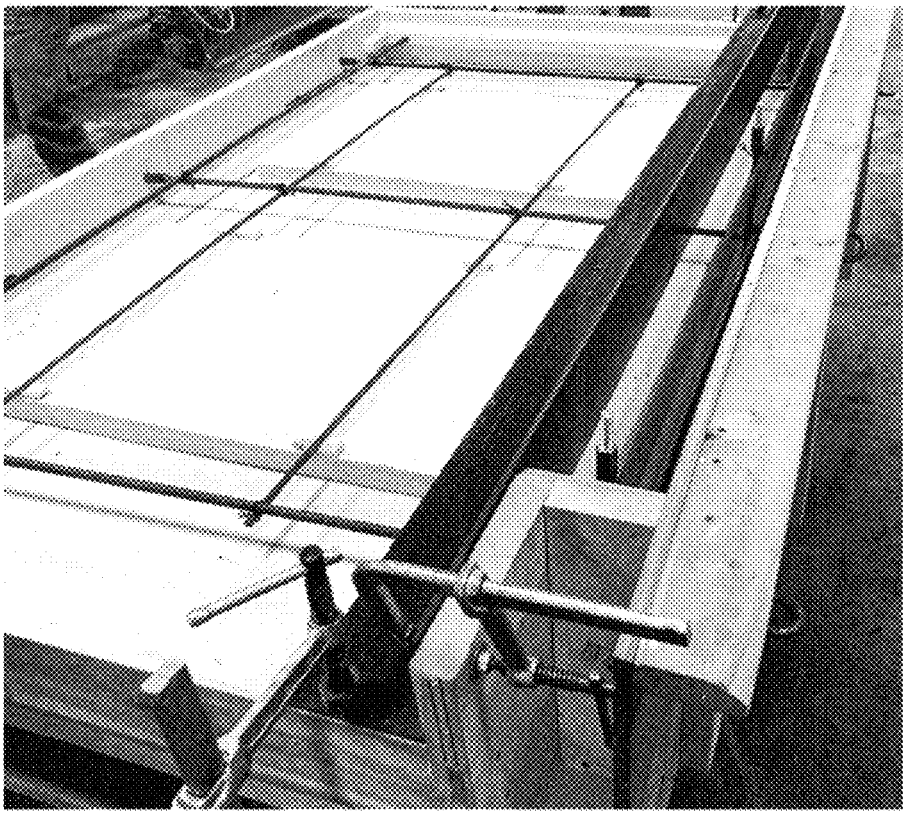
FIG. 21B is another perspective view of the initial casting mold shown in FIG. 21A.

A method of making pre-cast concrete wall segments 20, 21 according to an embodiment of the present disclosure will now be described with reference to FIGS. 20-21. As implied by the term "pre-cast," the method may be carried out at a location remote from the construction site, for example in an indoor facility. The method may comprise steps S1 through S6 indicated in by blocks in FIG. 20. In step S1, an initial casting mold is provided, wherein the initial casting mold includes a first region for forming vertical wall 26 in a horizontal orientation and a second region contiguous with the first region for forming an initial portion of footer 24, wherein the second region is deeper than the first region. FIGS. 21A and 21B show an embodiment of the initial casting mold from two different viewpoints. The first region of the initial casting mold horizontally forms all of vertical wall 26, and the second region of the initial casting mold forms most of footer 24, including the portion of footer 24 that is directly beneath vertical wall 26 when the wall segment is in its normal vertical and one portion of footer 24 which extends beyond a side face of vertical wall 26. In step S2, an initial portion of concrete from a batch of concrete is poured into the initial casting mold to fill the first and second regions of the initial casting mold. The initial portion of concrete has an initial pour level corresponding to an exposed side face of vertical wall 26 and an internal section of footer 24. According to step S3, a final casting mold may be installed on the second region of the initial casting mold, wherein the final casting mold defines a third region contiguous with the second region for forming a final remaining portion of footer 24. In step S4, a second portion of the same batch of concrete may be poured into the final casting mold to fill the third region defined by the final casting mold. The final portion of concrete has a final pour level that is above the initial pour level. According to step S5, the initial and final portions of poured concrete are allowed to cure to a final hardened state. In step S6, the initial and final casting molds are removed. It will be understood that full completion of step S5 is not necessary before step S6 is performed, and that the molds may be removed after the poured concrete has cured sufficiently to maintain its shape without the presence of the molds but before the poured concrete has reached its final hardened state.

This method takes advantage of the use of plasticizers in the concrete batch. After the batch is mixed, the first portion of the batch may be poured into the initial casting mold. After a given period of time when the plasticizer's effects wear off, the first portion of the batch will have stiffened in the initial casting mold without fully curing. During this period of time, which may be, for example, about twenty minutes, the final casting mold can be installed. After the period of time has elapsed, the second portion of the batch may be poured. Since the first portion of the batch is not cured at this point (only the effects of the plasticizer therein have worn off), the second portion of the batch will cure at the same time as the first portion of the batch so that the first and second poured portions bond with one another to form a monolithic concrete body without any seams. The method achieves a monolithic pre-cast concrete wall segment having both a vertical wall 26 and a footer 24 so that the wall segment will be safely freestanding on its own. Moreover, by casting the wall segment in a horizontal orientation, the pour depth remains shallow regardless of the height of vertical wall 26, and the height and length of the wall segment may be adjusted very easily by adjusting the location of sidewalls of the initial casting mold.

The present disclosure offers significant advantages and flexibility for installing a foundation wall at a construction site. The construction crew may excavate the construction site and grade a ground surface at the construction site. Pre-cast concrete wall segments 20, 21 may be transported to the construction site before, while, or after excavation and grading is performed. The freestanding wall segments may then be positioned at their target locations on the graded ground surface, and adjacent wall segments may be interconnected using connection brackets to form an assembled foundation wall. Finally, backfilling may be performed adjacent an exterior side of the foundation wall. Conveniently, the steps of positioning and backfilling may be performed on different days.

Although the present disclosure has been described with respect to one or more particular embodiments, it will be understood that other embodiments of the present disclosure may be made without departing from the scope of the present disclosure. Hence, the present disclosure is deemed limited only by the appended claims and the reasonable interpretation thereof.

What is claimed is:

1. A wall segment for constructing a foundation wall of a building, the wall segment comprising:

a pre-cast concrete monolithic body including a ground-engaging footer and a vertical wall supported by the footer and extending upwardly from the footer;

wherein the monolithic body is freestanding;

wherein the monolithic body includes a first end and a second end spaced from one another in a longitudinal direction of the monolithic body, wherein the vertical wall extends longitudinally beyond the footer at the first end and the footer extends longitudinally beyond the vertical wall at the second end; and a plurality of connection brackets, wherein a portion of each connection bracket is embedded in the monolithic body, one of the plurality of connection brackets being located at the first end of the monolithic body and another of the plurality of connection brackets being located at the second end of the monolithic body.

2. The wall segment according to claim 1, wherein the vertical wall includes an interior face and an exterior face spaced from one another in a lateral direction of the monolithic body, wherein the footer extends laterally beyond the interior face and the exterior face of the vertical wall.

3. The wall segment according to claim 1, wherein the vertical wall includes a tongue at one of the first and second ends of the monolithic body, and the vertical wall includes a groove at the other of the first and second ends of the monolithic body.

4. The wall segment according to claim 3, wherein the tongue is at the first end and the groove is at the second end.

5. The wall segment according to claim 2, wherein the vertical wall includes a tongue and a groove, wherein one of the tongue and the groove is formed in the interior face of the vertical wall.

6. The wall segment according to claim 5, wherein the groove is formed in the interior face and the tongue is formed at the first end of the monolithic body.

7. A wall segment for constructing a foundation wall of a building, the wall segment comprising:

a pre-cast concrete monolithic body including a ground-engaging footer and a vertical wall supported by the footer and extending upwardly from the footer;

wherein the monolithic body is freestanding;

wherein the monolithic body includes a first end and a second end spaced from one another in a longitudinal direction of the monolithic body, wherein the vertical wall extends longitudinally beyond the footer at the first end and the footer extends longitudinally beyond the vertical wall at the second end;

wherein the vertical wall includes a tongue at one of the first and second ends of the monolithic body, and the vertical wall includes a groove at the other of the first and second ends of the monolithic body; and a pair of identical connection brackets, wherein a portion of each connection bracket is embedded in the monolithic body, the pair of connection brackets including a first connection bracket having an outer face flush with an outer surface of the tongue and a second connection bracket having an outer face flush with an inner face of the groove.

* * * * *